United States Patent [19]

Schienda

[11] 4,045,628

[45] Aug. 30, 1977

[54] INTERLOCK FOR HANDLES OF ADJACENT CIRCUIT BREAKERS

[75] Inventor: John W. Schienda, Bellefontaine, Ohio

[73] Assignee: I-T-E Imperial Corporation, Spring House, Pa.

[21] Appl. No.: 659,670

[22] Filed: Feb. 20, 1976

[51] Int. Cl.[2] ..... H01H 9/26

[52] U.S. Cl. ..... 200/50 C

[58] Field of Search ..... 200/5 E, 50 C, 333, 200/334; 335/159-161

[56] References Cited

U.S. PATENT DOCUMENTS

| | | | |
|---|---|---|---|
| 3,319,020 | 5/1967 | Shaffer | 200/50 C |
| 3,801,758 | 4/1974 | Shand et al. | 200/50 C |

*Primary Examiner*—James R. Scott

*Attorney, Agent, or Firm*—Ostrolenk, Faber, Gerb & Soffen

[57] ABSTRACT

A mechanical interlock for circuit breakers using a depressible, push-button operating handle, wherein two circuit breakers are paired and at least two circuit breaker pairs are adjacent: the interlock comprises a molding placed on top of the casings of the circuit breakers and shiftable by depression of the handles of one circuit breaker pair to a position to block depression of the handles of the other circuit breaker pair; with a row of circuit breaker pairs, shifting of one interlock shifts all other interlocks for all other circuit breaker pairs.

13 Claims, 6 Drawing Figures

INTERLOCK FOR HANDLES OF ADJACENT CIRCUIT BREAKERS

BACKGROUND OF THE INVENTION

The present invention relates to circuit breakers in general, to push-push circuit breakers in particular and more particularly to a mechanical interlock for preventing operation of one push-push circuit breaker upon operation of another.

The push-push circuit breaker of the type with which the present invention is principally adapted for use is described in U.S. Pat. No. 3,075,058 issued to Elwood T. Platz and Victor Mitchnick on Jan. 23, 1963, entitled "Push-Push Circuit Breaker", and assigned to the assignee hereof. That patent is incorporated herein by reference for its teaching of the design and operation of such circuit breakers. The circuit breaker is manually operated from the "on" or contacts engaged position to the "off" or contacts separated condition by depressing toward the circuit breaker casing a depressible push button handle which normally projects from the top side of the circuit breaker. Operation of the circuit breaker from "on" to "off" could be prevented by means which blocks depressing of the push-push button or handle. In such a circuit breaker, both of the line and the load terminals are usually located on the same, front side of the circuit breaker. The rear side of the circuit breaker has no circuit breaker operating elements projecting from or located on it. It has, therefore, become usual to pair two such circuit breakers back to back with their rear sides facing toward each other and spaced apart a short distance and to provide a common cap for both operating handles, which cap bridges the gap between the paired circuit breakers and operates their handles together.

In typical panelboard installations, it is usual to gang the circuit breaker pairs in a row with the sides of the casings of the circuit breakers in adjacent circuit breaker pairs contacting.

In certain installations, when one push-push circuit breaker is "on", it is desirable that at least some of the other circuit breakers in the installation be prevented from being operated "on". When that first circuit breaker is operated from "on" to "off", then those circuit breakers that had been disabled from being operable "on" should thereafter be operable "on".

SUMMARY OF THE INVENTION

It is the primary object of the present invention to provide an interlock that will prevent the simultaneous closing of the contacts of two adjacent circuit breakers.

It is another object of the invention to interlock a plurality of circuit breakers so that only one of them can be operated to a contacts closed position at any one time.

It is a further object of the invention to accomplish the foregoing objects in connection with push-push circuit breakers.

It is another object of the invention in a ganged array of circuit breakers or of pairs thereof to prevent all but one circuit breaker or pair thereof to be operated to a contacts closed position at any one time.

It is yet another object of the invention to provide an interlock for accomplishing the foregoing objects.

It is a further object of the invention that the interlock be esthetically pleasing.

It is yet another object of the invention that the interlock be economically manufacturable.

It is another object of the invention that the interlock be easily installable when the circuit breakers which are interlocked are being installed or after they have been installed in a panelboard.

It is a further object of the invention to provide such an interlock which can be received by push-push circuit breakers without any modification of the circuit breakers or of their casings.

It is yet another object of the invention to provide such an interlock which will not interfere with the operator's view of the informational markings on the circuit breakers, including "on" and "off" indications, ampere ratings, short circuit ratings, etc.

To accomplish the foregoing objects, for use in connection with at least two adjacent, aligned in a row, push-push circuit breakers or, more usually, two aligned in a row pairs of such circuit breakers, a mechanical interlock is provided. The interlock is installed at the outside of the circuit breaker housings and in a location to block operation of the handle of one of the two adjacent circuit breakers or the handles of one of the two adjacent pairs of circuit breakers. The interlock comprises a unitary molding shaped to comprise a central support bar passing through the space between the handles to be interlocked and across the circuit breaker from front to rear across the entire circuit breaker pair. There is a respective handle depression preventing leg on each side of the bar, which legs are movable to block and interfere with depression of the operating handles of the circuit breaker or pair of circuit breakers toward which the interlock is shifted.

In the typical installation comprising back-to-back push-push circuit breaker pairs aligned in a row, the handle depression preventing leg on one side of the support bar of the interlock is shiftable to engage, i.e. pass under and block movement of, the cap that joins the handles of one back-to-back circuit breaker pair, and the corresponding leg on the other side of the interlock support bar is shiftable to similarly engage the cap that joins the handles of the adjacent circuit breaker pair. The circuit breaker handle depression blocking legs on both sides of the interlock support bar are of a length such that when one such leg is in a position to block depression of its respective handles, the other leg is shifted sufficiently away from its respective handles that the latter handles may be freely depressed to operate those circuit breakers "on" or "off".

The interlock further comprises outboard guide legs projecting from both sides of the support bar and located beyond or outboard of the front sides of the circuit breaker handles and their joining caps. The guide legs extend alongside their respective breaker handle caps toward the next adjacent circuit breaker. The guide legs both stabilize and guide the motion of the interlock. The guide legs are of sufficient length that each remains in engagement with its respective circuit breaker handle throughout the shifting of that interlock, yet the legs are short enough not to block viewing of indicia applied on the handle with which the guide leg cooperates.

Circuit breakers or more typically circuit breaker pairs are ganged in a row, as on a panelboard. In accordance with a further development of the invention, an interlock may be positioned between adjacent circuit breaker pairs, such that one circuit breaker or one circuit breaker pair located inwardly from the ends of the row has a first interlock cooperating between the one circuit breaker or one pair thereof and a second, next adjacent circuit breaker or pair thereof on one side and a second interlock cooperating between the one circuit breaker or pair thereof and a third, next adjacent circuit breaker or pair thereof on the opposite side of the one circuit breaker or pair thereof. Further beyond the guide legs on the interlock are positioned ganged interlock activator legs which extend parallel to their respective guide legs but are of a greater length and are so shaped that when one interlock is shifted to one of its circuit breaker handle depression blocking positions, its activator legs engage the activator legs of the next adjacent interlock and similarly shift it in the same direction to a circuit breaker handle operation blocking position. Because there is an interlock between each adjacent circuit breaker or pair thereof, enabling operation of one circuit breaker or pair thereof of the "on" position, requires shifting in series of all other interlocks that are in position to be engaged and shifted by the activator legs of the next adjacent interlock.

In accordance with a preferred development of the invention, each interlock comprises a single plastic molding which is shaped so as to comfortably fit around the handles and the handle caps with which it must cooperate and so as to have clearances, channels and pockets to accommodate the various structural components and casings of the circuit breakers with respect to which each interlock shifts.

Realization of the foregoing objects and a better understanding of the invention can be obtained from the following description of the accompanying drawings.

DETAILED DESCRIPTION OF THE INVENTION

The present invention relates to an interlock for use with a plurality of circuit breaker pairs 10, 11 and 13, 14 and 15, 16 and a continuing row of similar circuit breaker pairs not shown. Each circuit breaker is of the type shown in U.S. Pat. No. 3,075,058, which is incorporated herein by reference.

Figure 1:
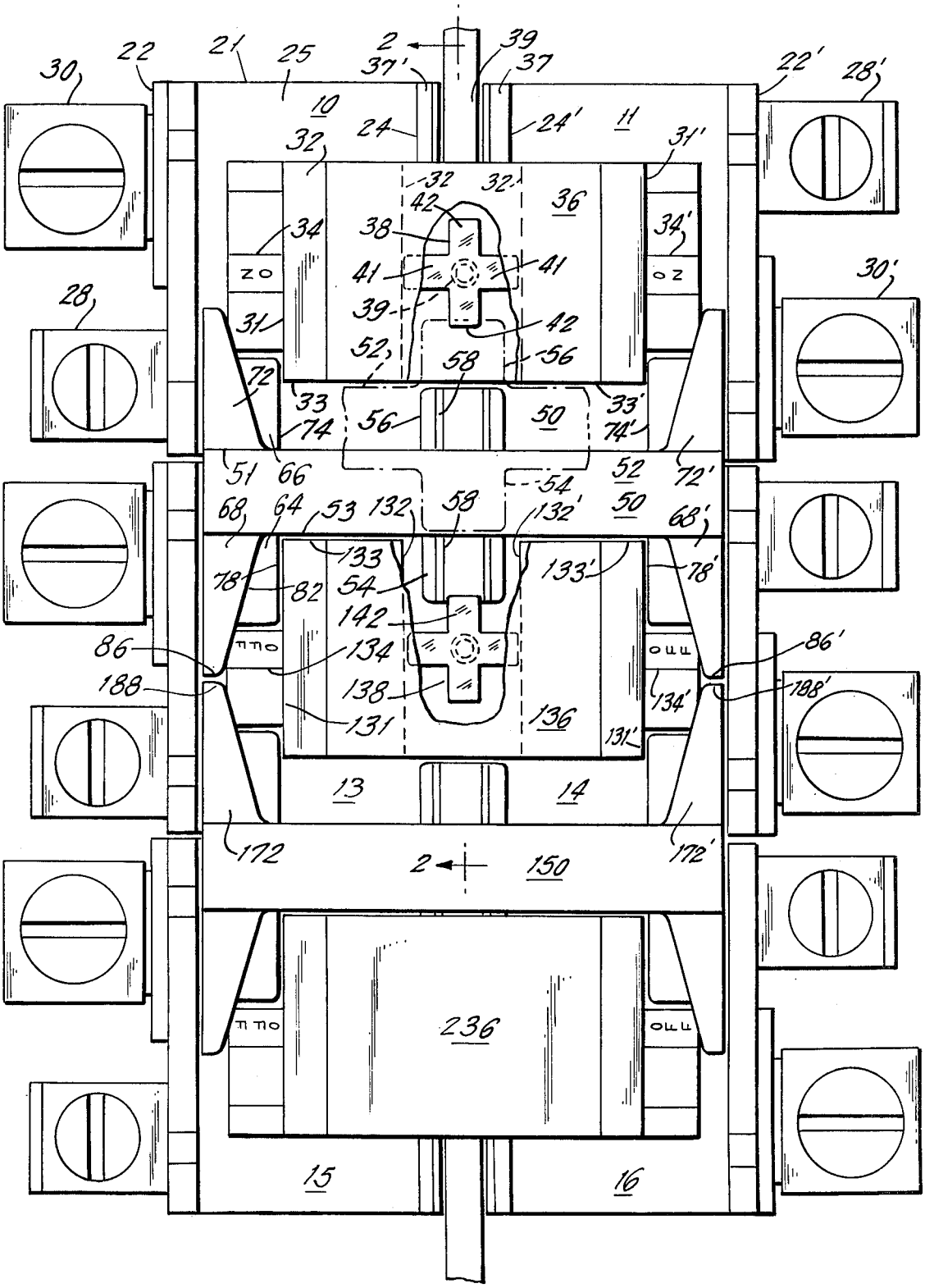
FIG. 1 is a top plan view of ganged circuit breaker pairs in association with interlocks in accordance with the invention.

As shown in FIG. 1, the circuit breaker pairs 10–16 are ganged, i.e. arranged in an elongated row, as might occur on a typical circuit breaker panelboard. The housings of each circuit breaker pair 10, 11 abut the housings of the next adjacent circuit breaker pair 13, 14 and the housings of circuit breaker pair 13, 14 abut the housings of circuit breaker pairs 15, 16, etc.

Referring to circuit breaker 10, it has an external casing or housing 21 for the circuit breaker components. Housing 21 has a front side 22, a rear side 24 and a top 25. The line terminal 28 and the load terminal 30 both project from the front side 22 of the circuit breaker. These terminals are joined by a conductor having separable contacts in it and there are means which separate the contacts upon the occurrence of certain fault conditions. The handle is operated to manually separate and rejoin the contacts. The internal structure of the circuit breakers is so well known and is shown in U.S. Pat. No. 3,075,058, whereby it need not be shown here.

The handle 32 projects above the top side 25 of the casing. Handle 32 is generally rectangular in plan view (FIG. 1) with a front side 31 facing frontward, like casing side 22, and with a side 33 that faces the neighboring, adjacent circuit breaker 13.

Associated with handle 32 and carried on and movable with it is an "on"-"off" indicator 34 which changes its indication depending upon whether the handle is depressed (on) or up (off). The "on"-"off" indicator is located at the base of, centrally along the length of and projects frontward of handle face 31. It is visible from above the circuit breaker.

Figure 6:
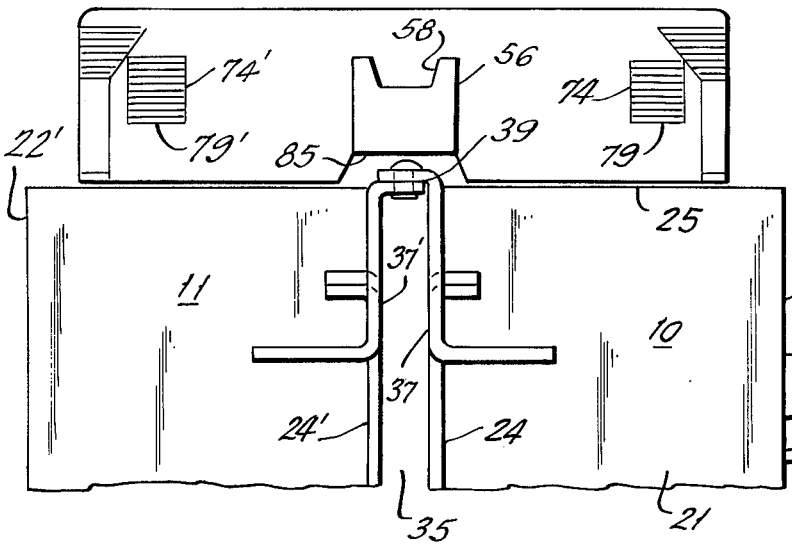
FIG. 6 is a side elevational view in the direction of arrows 6—6 in FIG. 3 showing the interlock atop the casings of a circuit breaker pair.

Referring to FIGS. 1 and 6, circuit breaker 11 is identical to circuit breaker 10 and those features of circuit breaker 11 which are hereinafter mentioned and which are identical to those of circuit breaker 10 will be identified by the same reference numerals followed by (′). The rear sides 24, 24′ of circuit breakers 10, 11 face toward each other and are gap separated by gap 35. Behind each casing rear surface 24, 24′ is respective backing plate 37, 37′, which includes projecting supports that extend into and engage the circuit breaker casings, for holding the circuit breakers securely in position. At the top of backing plates 37, 37′ is the junction 39 which includes a screw threaded, riveted, or the like connection for holding the backing plates in the position illustrated in FIG. 6. The below described interlock 50 is contoured to provide clearance for the securement junction 39, as discussed further below.

Figure 2:
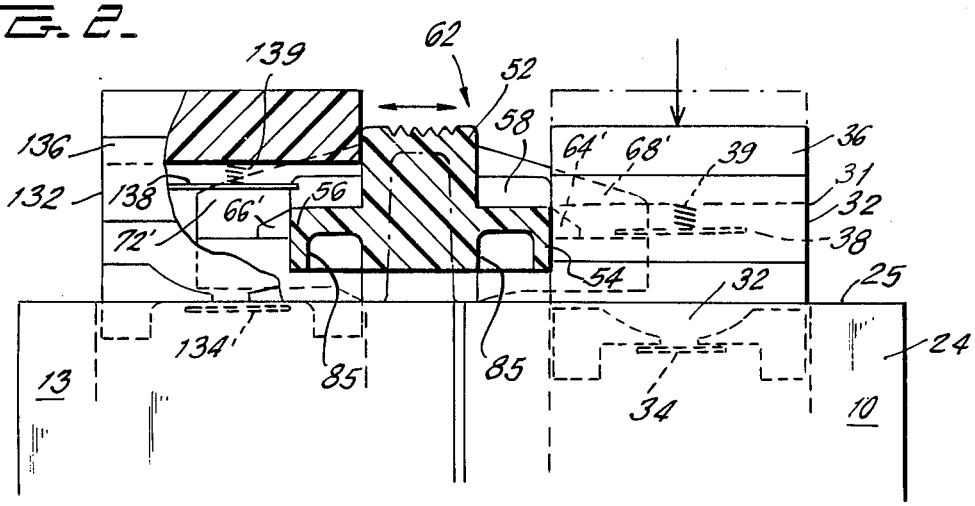
FIG. 2 is a side elevational view, partially in cross-section, of a fragment of the assembly of FIG. 1 along the line and in the direction of arrows 2—2 in FIG. 1.

Referring to FIGS. 1 and 2, extending between the handles 32 and 32′ is the handle cap 36, which bridges across, seats on and is attached to the handles 32, 32′. It is the handle cap 36 that is pressed upon and this, in turn, depresses both of the handles 32, 32′ for operating the circuit breakers "on" and "off".

Beneath cap 36 is attached the cruciform shaped trip rock bar 38 which is suspended from the interior of cap 36 by compressible spring 39. Typically in a circuit breaker pair arrangement 10, 11, the legs 41 of bar 38 extend toward and their flattened ends press against the interior, facing walls of handles 32, 32′. This serves to guide and maintain the illustrated orientation of bar 38. The other legs 42 of bar 38 are aligned so as to normally abut and bottom on the top joint or junction of the backing plates 37, 37′, thereby assisting in the halting of the inward depression of the cap 36 and handles 32 at the ends of their strokes. In the present invention, the legs 42 perform an additional function and cooperate with the below described leg 56 of the interlock in preventing the cap 36 and thus the handles 32 from being improperly depressed.

The interlock 50 according to the present invention is an integral, unitary unit, most easily produced by molding. It is rigid. It is preferably comprised of plastic. The interlock 50 is comprised of the central support bar 52 which extends the full length of the interlock. Bar 52, as shown in FIG. 1, extends at least the distance between the front sides 31, 31′ of the handles and preferably the distance between the casing front sides 22, 22' of a circuit breaker pair. Bar 52 has opposite sides 51, 53 which respectively face toward sides 33, 33' of circuit breaker handles 32, 32' and sides 133, 133' of circuit breaker handles 132, 132'. The width of bar 52 between its sides 51, 53 is less than the distance between handle sides 33, 33' and 133, 133', enabling bar 52 and interlock 50 to be shifted between the solid and phantom line positions in FIG. 1.

For convenience of manual manipulation of bar 52 for shifting the interlock 50 top to bottom, as viewed in FIG. 1, the upper surface of bar 52 is ribbed as at 53 (FIG. 3) to provide a more easily gripped surface. Manual shifting of the interlock may also be accomplished by grasping of the enlarged below described legs 68, 72.

Figure 3:
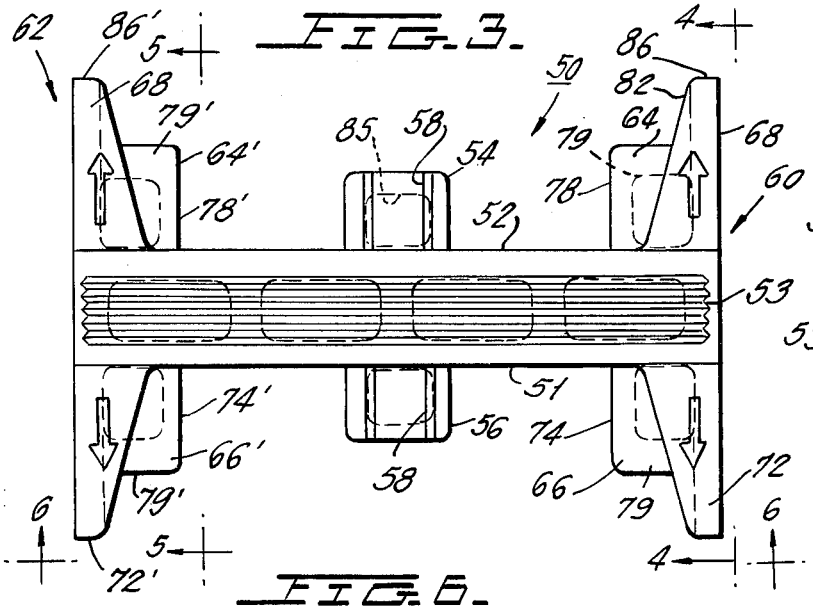
FIG. 3 is a top plan view of the interlock of the present invention.

Referring to FIGS. 1, 3 and 6, approximately centrally located along the length of bar 52 are oppositely projecting legs 54, 56, each projecting from respective sides 53, 51 of the bar 52 and being perpendicular thereto. Referring to FIG. 1, the length of legs 54, 56 is selected so that with the bar 52 moved as far to the bottom in FIG. 1 as the sides 133, 133' of handles 132, 132' of the circuit breakers 13, 14 would permit, the leg 54 extends beneath cap 136 and a short distance beneath arm 142 of trip rock bar 138 associated with the circuit breaker pair 13, 14 while the leg 56 is completely out from under the cap 36 so as to not interfere in any way with the depression of that cap. As shown in broken line, phantom form in FIG. 1, the interlock 50 may be shifted in the other direction toward the circuit breaker pair 10, 11 until the bar 52 is blocked by the sides 33, 33' of the handles 32, 32' from further movement to the right in FIG. 1. In this position, the leg 54 is away from the cap 136 associated with the circuit breaker pair 13, 14 and the leg 54 extends under the cap 36 and slightly under the arm 42 of the trip rock bar 38.

The top surfaces of legs 54, 56 are both channeled at 58 (see FIGS. 1–3 and 6), and the channels have a width and depth enabling them to receive the arms 42, 142 when the interlock 50 is shifted up and down, respectively, as shown in FIG. 1. The channels 58 are sufficiently deep to preclude the legs 54, 56 rubbing arms 42, 142 and interfering with the shifting of the interlock 50, and the channels are shaped such that at least the final movement of the interlock 50 is to some extent guided by the cooperation between the channels 58 and the leg 42, 142 of the appropriate trip rock bar.

Referring to FIGS. 3–6, at the opposite outer ends of bar 52 are respective outboard guide legs and ganged interlock activator leg assemblies 60, 62, which guide the shifting motion of the interlock 50, which are shaped so as to avoid obscuring the "on-off" indicators 34, 34', 134, 134' and which serve to activate corresponding interlocks 150, et al. on adjacent circuit breaker pairs. Assemblies 60, 62 are identically constructed and mirror imaged. Corresponding elements on assembly 62 have the same reference numeral and perform the same function as the correspondingly numbered elements of assembly 60 and the corresponding elements on assembly 62 are given the same reference numerals followed by (').

Assembly 60 is comprised of the first interlock motion guide leg 64 which projects in one direction away from bar side 53 and the second interlock motion guide leg 66 which projects away from bar side 51 in the opposite direction. Assembly 60 further includes the first ganged interlock activator leg 68 extending in the same direction as guide leg 64 and the second ganged interlock activator leg 72 extending in the opposite direction from leg 68 and in the same direction as guide leg 66.

Referring to interlock guide leg 66, it is shaped and has a thickness such that its inner side wall 74 rubbingly engages and slides against the cooperating front or outer side 31 of the handle 32. Guide leg 64 is shaped correspondingly to leg 66, and inner side wall 78 of guide leg 64 rubbingly engages front side 131 of handle 132. The abutting, sliding engagement between guide leg walls 74, 74', 78, 78' and the circuit breaker handle front sides 31, 31', 131, 131' keeps the interlock 50 at the proper location and guides its movement along a straight line, in the manner shown in FIG. 1. The length of guide legs 64, 66 from bar 52 is also selected so that with the interlock fully shifted in one direction, as to the bottom in FIG. 1, the "on"-"off" indicator 134 remains uncovered and visible from the top of the circuit breaker, and, in addition, the conventional ampere rating information (not shown) which appears on the front side 131 of the handle above the "on"-"off" indication is also visible. Furthermore, the guide leg length is such that the guide legs remain in continuous engagement with the circuit breaker handles as the interlock shifts.

In addition, the arms 64, 66, 64' and 66' have respective inclined top surfaces as at 79, 79', which taper narrower away from bar 52, enhancing the indicator and indicia visibility.

Interlock activator leg 68 is further outboard of guide leg 64. Activator leg 68 extends a greater distance from bar 52 and is longer than leg 64 and might obscure the "on"-"off" indicator 34. However, the inwardly facing surface 82 of leg 68 tapers gradually narrower in width moving outwardly away from bar 52 as shown in FIGS. 1 and 3, and at the point where the surface 82 would extend past an "on"-"off" indicator 134, it is sufficiently narrow as to not obscure that indicator, as shown in FIG. 1. The width of the other activator arms 72, 68', 72' correspondingly tapers for the same reason.

Figure 4:
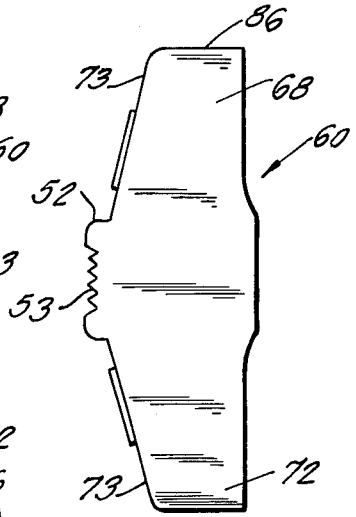
FIG. 4 is a side elevational view in the direction of arrows 4—4 in FIG. 3 of the interlock.
Figure 5:
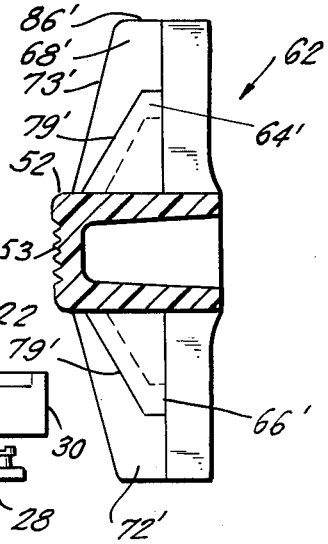
FIG. 5 is a cross-sectional view in the direction and along the line of arrows 5—5 in FIG. 3 of the interlock.

With reference to FIGS. 4–6, the height of the arms 68, 72 and 68', 72' tapers narrower moving away from bar 52 so that the portion of the upper surface 73 of arm 68, 72 etc. that would be in front of any rating indication on the front sides 31, 131, etc. of handles 32, 132, etc., which rating indication might be written above the "on"-"off" indicator 34, 134, etc., would be visible above the upper surface 73 of the respective interlock activator leg.

Referring to FIG. 1, the total length of the interlock activator legs 68, 72 is selected so that from the tip of leg 68 to the tip of leg 72, the length of these legs plus the width of bar 52 is equal to the length along the row of circuit breakers of one circuit breaker 10, et al., and particularly the length of that circuit breaker on which interlock 50 sits.

Referring to FIG. 1, the interlock 50 is between the circuit breaker pair 10, 11 and the circuit breaker pair 13, 14. Between the circuit breaker pair 13, 14 and the circuit breaker pair 15, 16 is a second interlock 150 which in all respects is identical to interlock 50. When the interlock 50 is shifted down to the solid line position in FIG. 1, it is apparent that because its leg 54 is beneath the cap 136, the cap 136 and the respective handles 132, 132' cannot be depressed. At the same time, the tips 86, 86' of the activator legs 68, 68' engage and abut the tips 188, 188' of the activator legs 172, 172' of the interlock 150. Such abutment forces the interlock 150 down to the position shown in FIG. 1 such that the interlock 150 functions, in the same manner as interlock 50 does, to block depression of the cap 236 and the associated handles (not shown) of the corresponding circuit breakers 15, 16.

Although three circuit breaker pairs and two cooperating interlocks are shown, it is apparent that a larger number of circuit breaker pairs may be ganged in a row. If there is a respective interlock, like interlock 50, between all of the circuit breaker pairs in a row thereof, the shifting of one interlock 50 to release the respective cap 36 for one circuit breaker pair will serve to shift all of the other interlocks 150, etc. to positions where they will block depression of their respective caps, like 136, 236 on all of the other circuit breaker pairs, whereby only a single circuit breaker pair may be operated on the "on" condition at any one time.

As shown in FIGS. 2, 3 and 5, the underside of interlock 50 is provided with a number of pockets, depressions, or the like for economy and ease in making the integral molding, and also to provide necessary clearances for the interlock above the expected obstructions projecting up from the top of a circuit breaker casing. As shown in FIG. 6, the securement at junction 39 projects upwardly and the pockets 85 in the bottom of the interlock 50 provide needed clearance.

Although the present invention has been described in connection with a preferred embodiment thereof, many variations and modifications will now become apparent to those skilled in the art. It is preferred, therefore, that the present invention be limited not by the specific disclosure herein, but only by the appended claims.

I claim:

1. An interlock for preventing operation of one circuit breaker to the "on", contacts engaged position when an adjacent circuit breaker has been operated to the "on", contacts engaged position, wherein both adjacent circuit breakers are of the type having contact position controlling handles that are operated by pushing the handle of the circuit breaker into its casing, wherein the adjacent circuit breakers are aligned such that their corresponding terminals and handles are aligned in respective rows, and wherein the circuit breakers and their handles have front sides facing in the same direction and the handles of the adjacent circuit breakers each have a side facing toward a side of the handle of the other adjacent circuit breaker;

the interlock comprising:

a bar of a length to extend across the casing of each of the adjacent circuit breakers; said bar being located between the handles of the adjacent circuit breakers; said bar having opposite outwardly facing sides and being of a width between its said sides that is less than the distance between the spaced apart, facing sides of the handles of the adjacent circuit breakers, such that said bar is shiftable toward both handles of the adjacent circuit breakers;

said bar having opposite ends; at at least one said end of said bar is a pair of guide legs; one said guide leg of said pair of guide legs projects from each said bar side toward the respective circuit breaker at that said side of said bar; each said guide leg being shaped and positioned to rubbingly engage the front side of the handle of its respective circuit breaker and each said guide leg being of a length sufficient for enabling each said guide leg of said pair to continuously engage its respective circuit breaker handle front side throughout shifting of said interlock;

a respective handle motion obstructing leg located intermediate the length of said bar and projecting from each said side thereof; said handle motion obstructing legs being shiftable by shifting of said bar; each said handle motion obstructing leg being shiftable toward the circuit breaker handle on said side of said bar toward which that said handle motion obstructing leg extends; each said handle motion obstructing leg being so shaped and positioned as to block depression of the circuit breaker handle toward which that said leg extends;

said handle motion obstructing legs being of such length that when said bar is fully shifted toward and engages and is blocked from further shifting in that direction by one circuit breaker handle, said handle motion obstructing leg which is provided for blocking the handle of the other, adjacent circuit breaker is sufficiently away from that other circuit breaker handle as not to block depression of that handle.

2. The interlock of claim 1, further comprising activator legs for ganged circuit breakers, said activator legs comprising two further legs, each respectively projecting from one respective side of said bar; said activator legs being of a length such that the total length of said activator legs plus the width of said bar totals at least the length, in the direction of extension of said activator legs, of the one or the adjacent circuit breaker on which said interlock is used.

3. The interlock of claim 1, wherein on the side of each circuit breaker handle that is engaged by a said interlock guide leg, the circuit breaker handle carries indicia; said guide legs being of a length such that with said bar shifted into engagement with either circuit breaker handle of the adjacent circuit breakers, said guide legs are long enough to continuously remain in engagement with their respective circuit breaker handles, yet are short enough not to obscure the circuit breaker handle carried indicia.

4. The interlock of claim 2, wherein on the side of each circuit breaker handle that is engaged by a said interlock guide leg, the circuit breaker handle carries indicia; said guide legs being of a length such that with said bar shifted into engagement with either circuit breaker handle of the adjacent circuit breakers, said guide legs are long enough to continuously remain in engagement with their respective circuit breaker handles, yet are short enough not to obscure the circuit breaker handle carried indicia;

said activator legs being located beyond said guide legs along said bar and being on the side of said guide legs further from said motion obstructing legs; said activator legs being of greater length than said guide legs and being located along said bar beyond said guide legs and being held by said guide legs in front of the indicia on the circuit breaker handles and being so shaped as not to block the circuit breaker handle carried indicia although said activator legs extend past that indicia.

5. An interlock for preventing operation of both circuit breakers of one circuit breaker pair to the "on", contacts engaged position when the circuit breakers of an adjacent circuit breaker pair have been operated to the "on", contacts engaged position, wherein all circuit breakers are of the type having contact position controlling handles that are operated by pushing the handle of the circuit breaker into its casing, and wherein the circuit breakers are arranged such that a first circuit breaker of one of the pairs is next to the first circuit breaker of an adjacent circuit breaker pair and such that the corresponding terminals and handles of the respective first circuit breakers are aligned in respective rows, wherein the second circuit breaker of each of the circuit breaker pairs is facing in the opposite direction from the respective first circuit breakers and such that those adjacent second circuit breakers are also aligned such that the corresponding terminals and handles of the respective second circuit breakers are aligned in respective rows; the adjacent first circuit breakers and their handles have front sides facing in the same direction and away from the second circuit breakers; the adjacent second circuit breakers and their handles have respective front sides facing in the same direction and opposite to the first circuit breaker front sides; each circuit breaker handle has a side facing toward a side of the handle of the adjacent circuit breaker in the other circuit breaker pair;

the interlock comprising:

a bar of a length sufficient to extend across both circuit breakers of each of the adjacent circuit breaker pairs and being located between the handles of the circuit breakers of one circuit breaker pair and the handles of the circuit breakers of the other adjacent circuit breaker pair; said bar having opposite outwardly facing sides and being of a width between its said sides less than the distance between the spaced apart, facing sides of the handles of one circuit breaker pair which face toward the facing sides of the handles of the other circuit breaker pair, such that the bar is shiftable toward the handles of both circuit breaker pairs;

said bar having opposite ends; at at least one said end of said bar is a pair of guide legs; one said guide leg of said pair of guide legs projects from each said bar side toward the respective said circuit breaker at that said side and at said one end of said bar; each said guide leg being shaped and positioned to rubbingly engage the front side of the handle of its respective circuit breaker and each said guide leg being of a length sufficient for enabling each said guide leg of said pair to continuously engage its respective circuit breaker handle front side throughout shifting of said interlock;

a respective handle motion obstructing leg located intermediate the length of said bar and projecting from each said side thereof; said handle motion obstructing legs being shiftable by shifting of said bar; each said handle motion obstructing leg being shiftable toward the handles of the circuit breaker pair on said side of said bar toward which that said handle motion obstructing leg extends; each said handle motion obstructing leg being so positioned and of a shape so as to be engaged by both handles of the circuit breaker pair toward which that said handle motion obstructing leg extends and to block depression of the handles of the circuit breaker pair toward which that said handle motion obstructing leg extends;

said handle motion obstructing legs being of such length that when said bar is fully shifted toward and engages and is blocked from further shifting in that direction by both handles of one circuit breaker pair, said handle motion obstructing leg which is provided for blocking the handles of the other circuit breaker pair is sufficiently away from the handles of that other circuit breaker pair as to not block depression of those handles.

6. The interlock of claim 5, further comprising activator legs for ganged circuit breakers, said activator legs comprising two further legs, each respectively projecting from one respective side of said bar; said activator legs being of a length such that the total length of said activator legs plus the width of said bar totals at least the length, in the direction of extension of said activator legs, of one of the circuit breakers of the pair on which said interlock is used.

7. The interlock of claim 6, wherein there is a first pair of said guide legs at said one end of said bar and a second pair of said guide legs at the opposite said end of said bar; said first guide legs have inwardly facing sides that rubbingly engage the outwardly facing front sides of the handles of the two adjacent first circuit breakers of two adjacent circuit breaker pairs; said second guide legs have inwardly facing sides that rubbingly engage the outwardly facing front sides of the handles of the two adjacent second circuit breakers of the two adjacent circuit breaker pairs, such that said guide legs are located at the outwardly facing front sides of both circuit breakers of both circuit breaker pairs.

8. In combination, at least two adjacently located circuit breaker pairs arranged in a row and an interlock for preventing operation of the circuit breakers of one circuit breaker pair to the "on", contacts closed position when the circuit breakers of the adjacent circuit breaker pair have been operated to the "on", contacts closed position:

each said circuit breaker comprising: a casing, including a front side, an opposite rear side, a top and two opposite side walls intersecting said front and rear sides and said top; a line and a load terminal; circuit forming and interrupting means, including closable contacts, electrically connected between said line and said load terminals; a handle projecting through said casing top and being so connected to said circuit forming and interrupting means that upon depression of said handle toward said casing and into said circuit breaker top, said circuit breaker is turned "on", its said contacts are closed and a circuit between said line and said load terminals is formed;

two said circuit breakers being paired and arranged with their said rear sides facing toward each other, and this comprises a circuit breaker pair;

two said circuit breaker pairs being arranged such that a said side wall of each said circuit breaker of one said circuit breaker pair is positioned adjacent an opposing said side wall of one said circuit breaker of the other said circuit breaker pair, and the corresponding said circuit breaker handles and said terminals of the adjacent said circuit breakers in the two said pairs are aligned in respective rows;

each said circuit breaker handle having a front side facing in the same direction as its said circuit breaker front side and also having a second side facing toward said handle of the adjacent said circuit breaker in the other said circuit breaker pair;

said interlock comprising:

a bar of a length at least the distance between said front sides of said handles of a said circuit breaker pair; said bar having opposite outwardly facing sides and being of a width between its said sides less than the distance between said circuit breaker handle facing second sides of two adjacent aligned said circuit breakers; said bar being located between said handle second sides of said handles of both pairs said circuit breaker pairs; each said bar opposite side facing toward a respective said circuit breaker pair; said bar being selectively shiftable toward both said handle pairs;

said bar having opposite ends; at each said end of said bar is a respective pair of guide legs; in each said guide leg pair, one said guide leg projects from each said side of said bar toward said handle of the respective said circuit breaker at that said side of said bar and at that said end of said bar; each said guide leg being shaped and positioned to rubbingly engage said front side of its respective said circuit breaker handle, and each said guide leg being of a length sufficient for enabling each said guide leg to continuously engage its respective said circuit breaker handle front side throughout shifting of said interlock;

located intermediate the length of said bar is a pair of circuit breaker handle motion obstructing legs, with a respective said handle motion obstructing leg projecting from each said side of said bar toward a respective said circuit breaker pair; each said handle motion obstructing leg being so shaped and positioned and said handles of said circuit breakers including formations so shaped that with said interlock shifted toward one said circuit breaker pair, the said handle motion obstructing leg on that said side of said bar engages said formations on said handles of that said circuit breaker pair for blocking depression of those said circuit breaker handles; said handle motion obstructing legs being of a length such that when said bar is fully shifted toward and engages said handle second sides of one said circuit breaker pair, said handle motion obstructing leg on the opposite said side of said bar is sufficiently away from the other said circuit breaker pair handles and the respective said formations as to not block depression of said handles of said other circuit breaker pair.

9. The combination of claim 8, further comprising at each said end of said bar and beyond said guide legs at each said end of said bar is a respective pair of activator legs for ganged said circuit breaker pairs; in each said activator leg pair, one said activator leg projects from a respective said side of said bar toward the respective said circuit breaker on that said side of said bar and at that said end of said bar; said activator legs of each said pair thereof being of a length such that the total length of said activator legs of a pair plus the width of said bar totals at least the length, in the direction of extension of said activator legs, of one said circuit breaker of the two said pairs thereof.

10. The combination of claim 8, wherein each said circuit breaker handle includes a portion that is visible when viewing said handle front side and which said portion carries indicia; said guide legs all being of a length such that with said bar shifted into engagement with said circuit breaker handle second sides of one said circuit breaker pair, said guide legs are short enough not to obscure the indicia carried by said handles which have been engaged by said bar.

11. The combination of claim 8, further comprising at each said end of said bar and beyond said guide legs at each said end of said bar is a respective pair of activator legs for ganged circuit breaker pairs; in each said activator leg pair, one said activator leg projects from a respective said side of said bar toward the respective said circuit breaker on that said side of said bar and at that said end of said bar; said activator legs of each said pair thereof being of a length such that the total length of said activator legs of a pair plus the width of said bar totals at least the length, in the direction of extension of said activator legs, of one said circuit breaker of said pairs thereof;

said activator legs being of greater length than said guide legs and being located along said bar beyond said guide legs and being held by said guide legs in front of said indicia on said circuit breaker handle front sides and being so shaped as not to block view of said indicia carried by said handles, although said activator arms extend past said indicia.

12. The combination of claim 11, wherein each said handle has a portion which is at, beneath and extends frontwardly a distance of its respective said handle said front side, which is generally parallel to said top of the respective said circuit breaker casing and which carries indicia to display the "on" and "off" conditions of that said circuit breaker; each said activator arm being spaced a distance forward of its respective said circuit breaker handle front side at least the distance of extension of the said indicia carrying portion frontward of said handle front side.

13. The combination of claim 8, wherein said handle formation comprises a respective handle cap for each said circuit breaker pair; each said cap extending between and joining said handles of its respective said circuit breaker pair so that said handles are depressed together;

said handle motion obstructing legs being so shaped and positioned and said cap being so shaped that upon shifting of said bar toward a said circuit breaker pair, the respective said handle motion obstructing leg engages that said cap and thereafter blocks that said cap from being depressed.

* * * * *